US005975160A

United States Patent [19]

Rush

[11] Patent Number: 5,975,160

[45] Date of Patent: Nov. 2, 1999

[54] EMERGENCY DISCHARGE CONTROL SYSTEM FOR STORAGE TANK AND CARGO TANK MOTOR VEHICLE

[76] Inventor: Gregory S. Rush, P.O. Box 222, Wanette, Okla. 74878

[21] Appl. No.: 08/957,443

[22] Filed: Oct. 24, 1997

[51] Int. Cl.[6] ..... B65B 1/04

[52] U.S. Cl. ..... 141/192; 141/94; 417/10; 417/63; 137/885; 251/129.04; 251/294

[58] Field of Search ..... 141/192, 94; 417/10, 417/63; 180/323, 324; 137/885; 251/129.04, 294

[56] References Cited

U.S. PATENT DOCUMENTS

| | | | |
|---|---|---|---|
| 2,544,955 | 1/1951 | Harrelson | 290/37 |
| 2,739,247 | 3/1956 | Pope | 290/38 |
| 3,657,696 | 4/1972 | Lessard et al. | 340/54 |
| 3,675,032 | 7/1972 | Shaheen | 290/38 |
| 3,773,066 | 11/1973 | Tyrner et al. | 251/294 |
| 3,828,819 | 8/1974 | Brogren | 251/294 |
| 4,110,629 | 8/1978 | Dotson et al. | 290/38 |
| 5,263,824 | 11/1993 | Waldbeser et al. | 417/10 |
| 5,311,851 | 5/1994 | Wright, Jr. | 123/630 |

FOREIGN PATENT DOCUMENTS 0202354 11/1986 European Pat. Off. ..... F16K 31/05

*Primary Examiner*—Steven O. Douglas

*Attorney, Agent, or Firm*—Dunlap, Codding & Rogers P.C.

[57] ABSTRACT

An emergency discharge control system for use with a cargo tank motor vehicle and a primary storage tank for remotely terminating the flow of product from the cargo tank of the cargo tank motor vehicle and the storage tank in an emergency situation is provided. The system includes a cylinder having a piston rod connected to a cable assembly of the cargo tank motor vehicle and a cylinder having a piston rod connected to a cable assembly of the primary storage tank for actuating the respective cable assemblies and closing the vapor valves and the liquid valves of the cargo tank and the primary storage tank. The piston rod is extended by passing pressurized fluid into the cylinder. A valve is interposed between the cylinder and a source of the pressurized fluid for controlling the flow of the pressurized fluid to the cylinder. A receiver mounted on the cargo tank motor vehicle is electrically connected to the valve and sends an electric signal to the valve so as to cause the valve to open and permit the pressurized fluid to pass to the cylinder in response to receiving a shutdown signal from a hand-held transmitter.

6 Claims, 4 Drawing Sheets

EMERGENCY DISCHARGE CONTROL SYSTEM FOR STORAGE TANK AND CARGO TANK MOTOR VEHICLE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to fluid flow control devices, and more particularly, but not by way of limitation, to a remotely operated discharge control system for use with the discharge systems of a tank for storing liquefied compressed gases and a cargo tank motor vehicle used to transport liquefied compressed gases.

2. Brief Description of the Related Art

Cargo vehicles used to transport liquefied compressed gases, such as propane, butane, gasoline, and diesel fuel, are required by law to have an emergency shutdown system which will terminate product discharge from the cargo tank in the case of a mechanical failure of hosing, fittings, or couplings which results in a spill. This emergency shutdown system is often in the form of an emergency handle mounted on a portion of the vehicle and coupled to a liquid control valve and a vapor control valve via a cable system. The valves are caused to close upon an operator pulling the emergency handle.

The problem encountered with such an emergency shutoff system is that the operator must have access to the emergency handle. However, the discharged gas is often highly flammable. Therefore, the operator may not be able to gain access to the emergency handle without risking injury to himself if the discharged gas has been ignited. Consequently, a system has previously been proposed for actuating the emergency shutdown system from a position remote from the vehicle.

This system is disclosed in U.S. Pat. No. 5,263,824, issued to Waldbeser et al. Waldbeser et al. discloses the use of a pulling solenoid connected to the cable system so that upon actuation of the solenoid, the cables are pulled and the valves are closed. The solenoid is connected to a vehicle mounted receiver which is capable of receiving signals from a hand-held transmitter. The receiver is additionally connected to the vehicle's ignition system so that the vehicle's engine is shut down to prevent ignition of the discharged gas by the vehicle's ignition system.

While the Waldbeser et al. system appears to be a satisfactory solution, problems are nevertheless still encountered in that the reliability of a pulling solenoid to actuate the cable system under all conditions, such as when the cable system is coated with mud or ice, is suspect.

In addition to the concerns associated with the unloading process, operators are faced with similar concerns while loading the cargo tank. That is, the tank receives liquefied compressed gas from a primary storage tank via a liquid line and a vapor line. A valve is interposed in each of these lines. Like the liquid discharge valve and the vapor valve discussed above, the valves interposed in the liquid line and the vapor line are coupled to an emergency shutdown system which generally includes a cable system actuated a distance from the valves. Also like the emergency shutoff system of the cargo vehicle, the operator may not be able to gain access to the emergency shutoff system of the storage tank, and if he can, he cannot be in two places at once. In other words, because the emergency handle of the vehicle is often located away from the emergency handle of the primary storage tank, the operator cannot pull the emergency handle for the vehicle and the primary storage tank simultaneously.

To this end, the need exists for an improved emergency discharge control system that allows an operator to terminate product discharge from the cargo tank and the storage tank from a safe, remote distance and which will effectively operate in harsh conditions. It is to such a system that the present invention is directed.

BRIEF SUMMARY OF THE INVENTION

The present invention is directed to an emergency discharge control system for use with a cargo tank motor vehicle for remotely terminating the flow of product from the cargo tank of the cargo tank motor vehicle in an emergency situation. The system includes a cable assembly connected to a vapor valve and a liquid discharge valve of the cargo tank motor vehicle for closing each of these valves for actuating the cable assembly. To actuate the cable assembly from a remote distance, the apparatus further includes a cylinder having a piston rod connected to the cable assembly. The piston rod is extended by passing pressurized fluid into the cylinder. A valve is interposed between the cylinder and a source of the pressurized fluid for controlling the flow of the pressurized fluid to the cylinder. A receiver mounted on the cargo tank motor vehicle is electrically connected to the valve and sends an electric signal to the valve so as to cause the valve to open and permit the pressurized fluid to pass to the cylinder in response to receiving a shutdown signal from a hand-held transmitter.

The present invention is also directed to an emergency discharge control apparatus for use with a storage tank as product is being transferred from the storage tank to a cargo tank motor vehicle.

The objects, features and advantages of the present invention will become apparent from the following detailed description when read in conjunction with the accompanying drawings and appended claims.

DETAILED DESCRIPTION OF THE INVENTION

Figure 1:
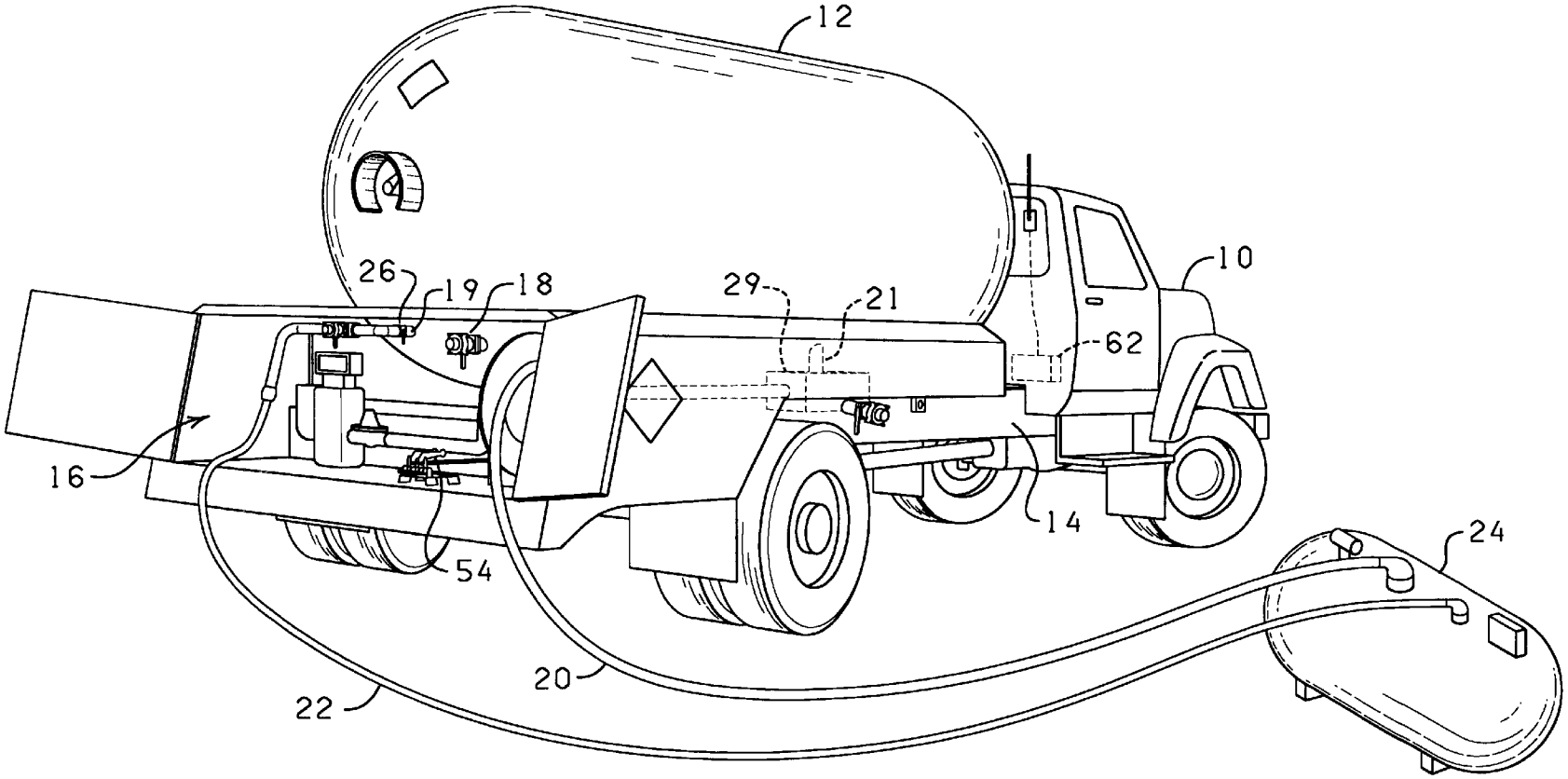
FIG. 1 is a perspective view of a cargo tank motor vehicle used to transport liquefied compressed gases illustrated unloading gas into a storage tank.

Referring now to the drawings, and more specifically to FIG. 1, a cargo tank motor vehicle 10 for storing and transporting a liquefied compressed gas is shown. The vehicle 10 has a cargo tank 12 in which the liquefied compressed gas is stored. The cargo tank 12 is mounted to and supported by a frame 14 of the vehicle 10. At its rearward end, the cargo tank 12 is provided with a loading and unloading connection area 16 which permits product to be loaded into and unloaded from the cargo tank 12.

The loading and unloading connection area 16 includes a liquid inlet 18, a vapor port 19, and a liquid outlet 21. A liquid discharge hose 20 is coupled to the liquid outlet 21 and a vapor equalization hose 22 is coupled to the vapor port 19. As illustrated in FIG. 1, the liquid discharge hose 20 and the vapor equalization hose 22 are adapted to be connected to a storage tank 24 so as to permit product to be transferred from the cargo tank 12 of the vehicle 10 to the storage tank 24 where the product is stored for commercial or residential purposes. The flow of vapor to and from the cargo tank 12 is controlled by a vapor valve 26 interposed between the vapor equalization hose 22 and the cargo tank 12. Similarly, the flow of liquid from the cargo tank 12 is controlled by a liquid discharge valve 28 (FIG. 2) which is typically mounted inside the cargo tank 12 connected to a discharge pump 29 via the liquid outlet 21.

As a safety feature, vehicles used to transport liquefied compressed gases are required by law to have an emergency discharge control system for stopping the flow of product from the cargo tank 12 in emergency situations such as when a pipe, fitting or hose fails during product transfer. The primary emergency discharge control system has been a cable system 30 which enables the vapor valve 26 and the liquid discharge valve 28 to be manually closed from a position on the vehicle 10 remote from the loading and unloading connection area 16. The cable system 30 is manually actuated from an emergency handle 32 (FIG. 2) which is required to be located at the end of the cargo tank 12 opposite where the loading and unloading connection area 16 is located, or in this case at the forward end of the cargo tank 12. As mentioned above, even though the emergency handle 32 is positioned away from the loading and unloading connection area 16, many emergency situations involve ignition of discharged gas and, therefore, the operator may not be able to gain access to the emergency handle 32 without risking injury to himself.

Figure 2:
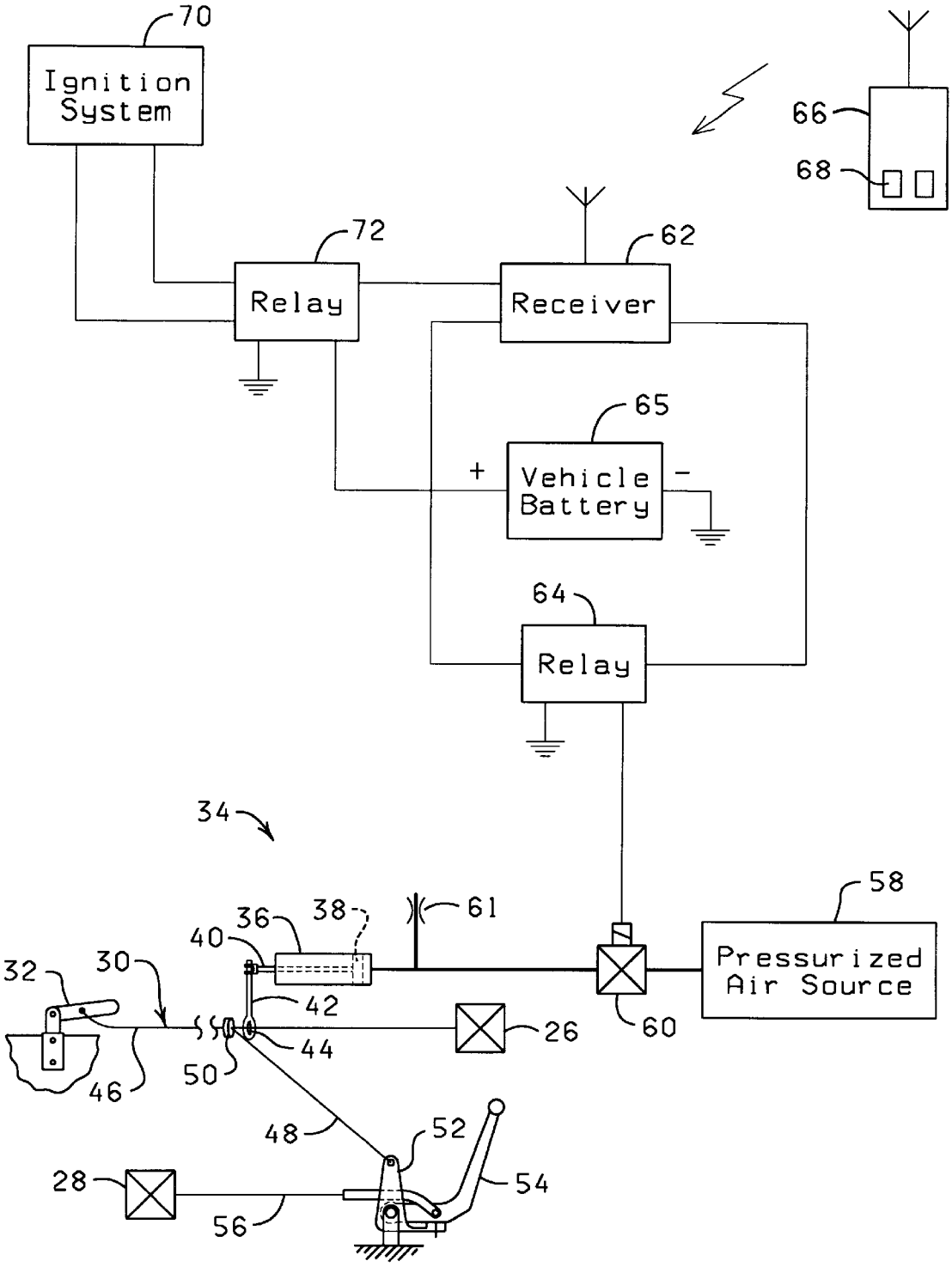
FIG. 2 is a schematic diagram of a remotely operated discharge control system constructed in accordance with the present invention for use with the discharge system of the cargo tank motor vehicle shown in FIG. 1.

Referring now to FIG. 2, an emergency discharge control apparatus 34 constructed in accordance with the present invention is shown connected to the cable system 30 of the vehicle 10 so as to enable an operator to actuate the cable system 30 and thus close the vapor valve 26 and the liquid discharge valve 28 from a position remote from the vehicle 10. The emergency discharge control apparatus 34 includes a cylinder 36 having a piston 38 and a piston rod 40 associated therewith. The distal end of the piston rod 40 extends from the cylinder 36 and is connected to the cable system 30 via a cable connector 42. The cable connector 42 can be any suitable device capable of connecting the piston rod 40 to the cable system 30 so as to not interfere with the manual operation of the cable system 30 via the emergency handle 32. Thus, the cable connector 42 preferably has an opening 44 adapted to slidably receive one of the cables of the cable system 30.

It will be appreciated by those skilled in the art that the cable system 30 may take many forms. However, by way of example, the cable system 30 illustrated in FIG. 2 includes a primary cable 46 having one end connected to the emergency handle 32 and an opposing end connected to the vapor valve 26. The cable system 30 further includes a second cable 48 which has one end connected to the primary cable 46 with a cable clamp 50. The other end of the second cable 48 is connected to a trip switch 52. The trip switch 52 functions to trip a handle 54 (shown in an open position) which is connected to the liquid discharge valve 28 via a cable 56. In the example of the cable system 30 described herein, the trip switch 52 and the handle 54 are positioned at the rearward end of the cargo tank 12 at the loading and unloading connection area 16.

The cable connector 42 is illustrated as being connected to the primary cable 46 so as to be engagable with the cable clamp 50 upon actuation of the piston 38 and the piston rod 40. However, any other suitable device may be connected to the cable system 30 so as to be engagable with the cable connector 42. The piston 38 and the piston rod 40 are actuated to an extended position wherein the cable system 30 is actuated so as to close the vapor valve 26 and the liquid discharge valve 28 by passing a pressurized fluid source 58 into the cylinder 36. The pressurized fluid source 58 is preferably pressurized air or vapor from the cargo tank 12. However, it will be appreciated that the cylinder 36 may be a hydraulic cylinder actuated with a hydraulic fluid. By using air rather than a hydraulic fluid, it will be appreciated that the cylinder 36 can be connected to the vapor equalization hose 22 or connected into the air system of the vehicle 10 and the need for a hydraulic pump is eliminated. Alternatively, pressurized air may be stored in an air storage tank mounted on the vehicle 10.

To control the flow of pressurized fluid to the cylinder 36 from the pressurized fluid source 58, a solenoid valve 60 and a manual reset valve 61 are interposed between the cylinder 36 and the pressurized fluid source 58.

The solenoid valve 60 is electrically connected to an RF receiver 62 via a relay 64, which is connected to the power source of the vehicle 10, typically a 12V battery 65. The receiver 62 is mounted in the cab of the vehicle 10 or some other suitable location on the vehicle 10. A shutdown signal is provided to the receiver 62 by a hand-held transmitter 66. The hand-held transmitter 66 has a push button switch 68 which permits an operator to provide a remotely generated shutdown signal to the receiver 62 in an emergency situation. Upon the receiver 62 receiving the shutdown signal from the hand-held transmitter 66, the receiver 62 outputs a signal to the relay 64 thereby causing the relay 64 to energize the solenoid valve 60 and thus cause the solenoid valve 60 to open and permit the pressurized fluid to pass to the cylinder 36. The manual reset valve 61 is actuated to release the fluid pressure from the cylinder 36 to allow the cylinder 36 to return to the retracted position upon the solenoid valve 60 being de-energized and closed.

The receiver 62 is additionally electrically connected to the ignition system 70, including an engine coil or solenoid, of the vehicle 10 via a relay 72. Upon receipt of the shutdown signal from the hand-held transmitter 66, the receiver 62 sends a signal to the relay 72 so as to cause the ignition system 70 to discharge its inductive energy and thus cause the engine of the vehicle 10, and thus the discharge pump 29, to shut down.

Upon realizing that an emergency situation exists because a pipe, hose, or fitting has failed during the loading or unloading process and thus product, which is generally highly flammable, is being discharged from the cargo tank 12 into the atmosphere, an operator engages the push-button switch 68 of the hand-held transmitter 66. Engagement of the push-button switch 68 sends a shutdown signal to the receiver 62. The receiver 62 in turn sends a signal to the relay 72 which causes the engine of the vehicle 10 to shut down, and the receiver 62 sends a signal to the relay 64 thereby causing the solenoid valve 60 to be energized. Energizing the solenoid valve 60 causes the solenoid valve 60 to open and thus cause pressurized fluid from the pressurized fluid source 58 to pass through the solenoid valve 60 and engage the piston 38 of the cylinder 36 so as to actuate the piston 38 and the piston rod 40 from the retracted position to the extended position. As the piston rod 40 travels from the retracted position to the extended position, the cable connector 42 is caused to engage the cable clamp 50 and actuate the primary cable 46. Actuation of the primary cable 46 causes the vapor valve 26 to close and causes the second cable 48 to trip the trip switch 52. Tripping of the trip switch 52 in turn causes the handle 54 to be rotated so as to permit the liquid discharge valve 28 to close. With the vapor valve 26 and the liquid discharge valve 28 closed and the engine and the discharge pump of the vehicle 10 shut down, the product in the cargo tank 12 is contained and the possibility of igniting the discharged product is greatly reduced by the shutdown of the engine of the vehicle 10.

Figure 3:
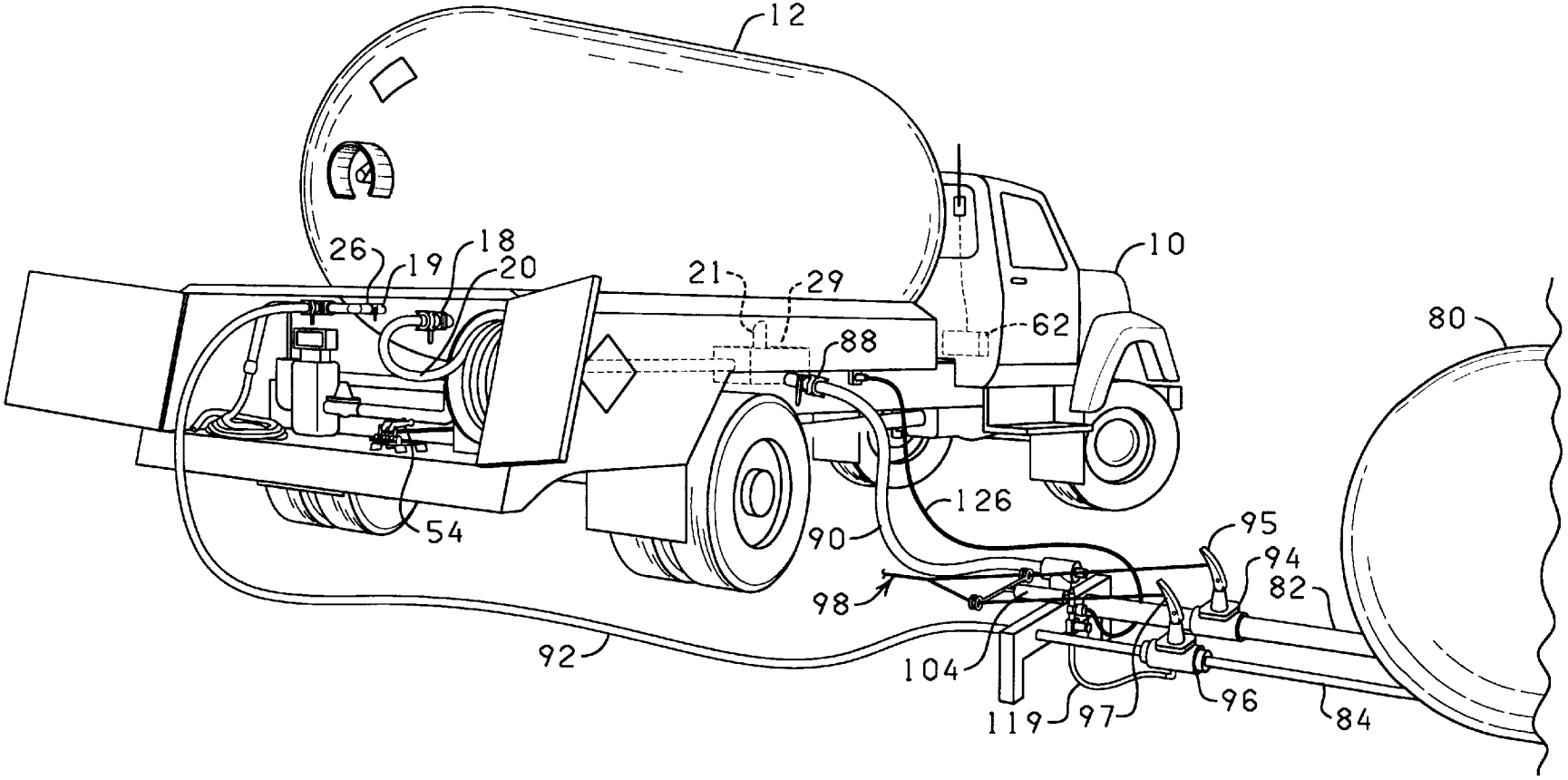
FIG. 3 is a perspective view of a cargo tank motor vehicle used to transport liquefied compressed gases illustrated receiving gas from a primary storage tank.

FIG. 3 shows the vehicle 10 located adjacent to a primary storage tank 80 with the cargo tank 12 of the vehicle 10 connected to the primary storage tank 80 for the purpose of transferring product from the primary storage tank 80 to the cargo tank 12. The primary storage tank 80 has a liquid outlet 82 and a vapor outlet 84. To transfer liquid from the storage tank 80 to the cargo tank 12, the liquid outlet 82 is connected to an inlet 88 of the discharge pump 29 via a liquid hose 90. The liquid discharge hose 20 of the vehicle 10 in turn is connected to the liquid inlet 18 of the cargo tank 12. The vapor outlet 84 of the storage tank 80 is connected to the vapor port 19 of the cargo tank 12 via a vapor hose 92.

To control the discharge of liquid and vapor from the storage tank 80, a valve 94 having a handle 95 is interposed in the liquid outlet 82 and a valve 96 having a handle 97 is interposed in the vapor outlet 84. Like the vapor valve 26 and the liquid discharge valve 28 of the vehicle 10, the valves 94 and 96 must be provided with an emergency discharge control system for terminating the discharge of product from the storage tank 80 in an emergency situation. Again, the primary emergency discharge control system for the valves 94 and 96 has been a cable system 98 which enables the valves 94 and 96 to be manually closed from a position remote from the valves 94 and 96. The cable system 98 is manually actuated from an emergency handle (not shown) which, while located a distance from the valves 94 and 96, is still generally located in close proximity to the storage tank 80. Consequently, in an emergency situation involving ignition of gas discharged from the storage tank 80, the operator may not be able to gain access to the emergency handle (not shown) without risking injury to himself.

Figure 4:
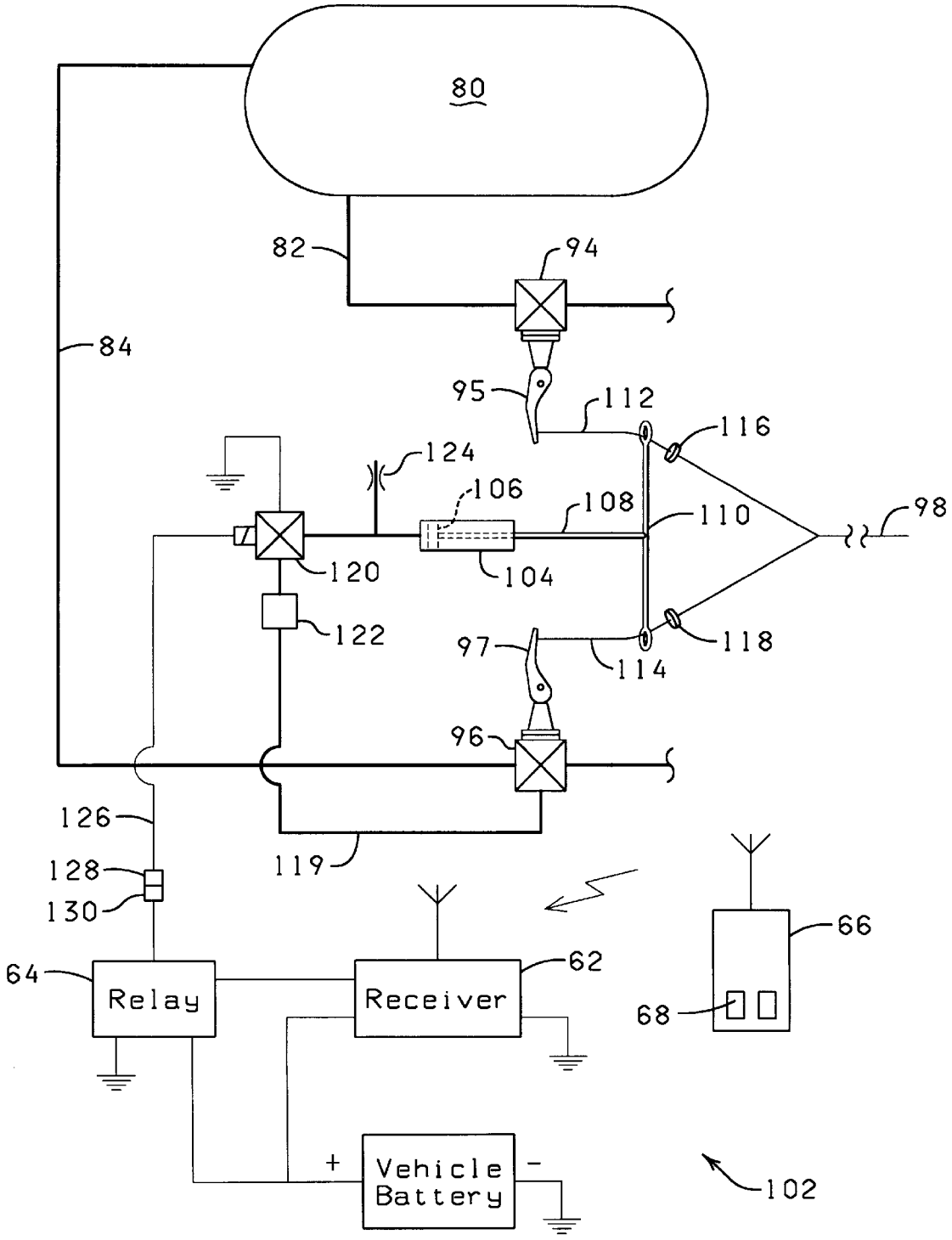
FIG. 4 is a schematic diagram of a remotely operated discharge control system constructed in accordance with the present invention for use with the discharge system of the primary storage tank shown in FIG. 3.

Referring now to FIG. 4, an emergency discharge control apparatus 102 constructed in accordance with the present invention is shown connected to the cable system 98 so as to enable an operator to actuate the cable system 98 and thus close the valves 94 and 96 from a position remote from the storage tank 80. The emergency discharge control apparatus 102 includes a cylinder 104 having a piston 106 and a piston rod 108 associated therewith. The distal end of the piston rod 108 extends from the cylinder 104 and is connected to the cable system 98 via a cable connector 110. The cable connector 110 may be any suitable device capable of connecting the piston rod 108 to the cable system 98 so as not to interfere with the manual operation of the cable system 98 via the emergency handle (not shown). As illustrated in FIG. 4, the cylinder 104 is mounted between the valves 94 and 96. Thus, the cable connector 110 has a first end adapted to slidably receive a cable extending from the valve 94 and a second end adapted to slidably receive a cable extending from the valve 96.

As with the cable system 30 described above, it will be appreciated by those skilled in the art that the cable system 98 may take many forms. However, by way of example, the cable system 98 illustrated in FIG. 4 includes a first cable 112 having one end connected to the handle 95 of the valve 94, and a second cable 114 having one end connected to the handle 97 of the valve 96. The opposing ends of the first and second cables 112 and 114 are connected to the emergency handle (not shown) such that the pulling of the emergency handle (not shown) causes the first and second cables 112 and 114 to be pulled and thus trip the handles 95 and 97 so as to close the valves 94 and 96.

The cable connector 110 is connected to the first cable 112 and the second cable 114 so as to be engagable with a cable clamp or stop member 116 attached to the first cable 112 and a cable clamp or stop member 118 attached to the second cable 114 upon actuation of the piston 106 and the piston rod 108. The piston 106 and the piston rod 108 are actuated from a retracted position to an extended position wherein the cable system 98 is actuated so as to close the valve 94 and the valve 96 by passing a pressurized fluid source into the cylinder 104. As illustrated in FIG. 4, the pressurized fluid source is the vapor pressure in the vapor hose 92. More specifically, the cylinder 104 is connected to the valve 96 via a hose 119 so that the vapor outlet 84 is in fluid communication with the cylinder 104. Alternatively, a tank for storing pressurized air may be connected to the cylinder 104. Also, it will be appreciated that the cylinder 104 may be a hydraulic cylinder actuated with a hydraulic fluid.

To control the flow of pressurized fluid to the cylinder 104 to the valve 96, a solenoid valve 120, a regulator 122, and a manual reset valve 124 are interposed between the cylinder 104 and the valve 96.

In a preferred embodiment, the solenoid valve 120 is electrically connected to the receiver 62, which is mounted in the cab of the vehicle 10 via an electric line 126 having a plug 128 which is adapted to be received by a receptacle 130 mounted on the vehicle 10. The receptacle 130 is electrically connected to the receiver 62. As described above, a shutdown signal is provided to the receiver 62 by the hand-held transmitter 66. The hand-held transmitter 66 has a push-button switch 68 which permits an operator to provide a remotely generated shutdown signal to the receiver 62 in an emergency situation. Upon the receiver 62 receiving the shutdown signal from the hand-held transmitter 66, the receiver 62 outputs a signal to the relay 64 thereby causing the relay 64 to energize the solenoid valve 120 and thereby cause the solenoid valve 120 to open and permit the pressurized fluid to pass to the cylinder 104. It will also be appreciated that the solenoid valve 60 will be energized so as to cause the cylinder 36 to operate in the manner described above. The manual reset valve 124 is actuated to release the fluid pressure from the cylinder 104 to allow the cylinder 104 to return to the retracted position upon the solenoid valve 120 being de-energized and closed.

In use, an operator will connect the liquid hose 90 to the inlet 88 and connect the vapor hose 92 to the vapor port 19. The operator will additionally connect the electrical line 126 of the solenoid valve 120 to the receptacle 130 of the vehicle 10, and open the valve 94 and the valve 96 by lifting the handles 95 and 97, respectively. The vapor valve 26 of the cargo tank 12 is opened, and the discharge pump 29 is engaged thereby initiating the transfer of product from the storage tank 80 to the cargo tank 12.

Upon realizing that an emergency situation exists because a pipe, hose, or fitting has failed during the loading process, and thus product is being discharged from the primary storage tank 80 and/or the cargo tank 12 of the vehicle 10, the operator simply pushes the push-button switch 68 of the hand-held transmitter 66. Engagement of the push-button switch 68 sends a shutdown signal to the receiver 62. The receiver 62 in turn sends a signal to the relay 72 which causes the engine of the vehicle 10 to shut down, and the receiver 62 sends a signal to the relay 64 thereby causing the solenoid valve 60 and the solenoid valve 120 to be energized. Again, energizing the solenoid valve 60 causes the solenoid valve 60 to open and thus permit pressurized fluid from the pressurized fluid source 58 to pass through the solenoid valve 60 and engage the piston 38 of the cylinder 36 and thus move the piston 38 and the piston rod 40 from the retracted position to the extended position. As the piston rod 40 travels from the retracted position to the extended position, the cable connector 42 is caused to engage the cable clamp 50 and actuate the primary cable 46. Actuation of the primary cable 46 causes the vapor valve 26 to close and thereby prevent the discharge of vapor from the cargo tank 12. The liquid discharge valve 28 will not be affected during the loading process in that the liquid discharge valve 28 is closed during the loading process.

Energizing the solenoid valve 120 causes the solenoid valve 120 to open and thus permit pressurized fluid from the valve 96 to pass through the solenoid valve 120 and engage the piston 106 of the cylinder 104 so as to move the piston 106 and the piston rod 108 from the retracted position to the extended position. As the piston rod 108 travels from the retracted position to the extended position, the cable connector 110 is caused to engage the cable clamps 116 and 118 and thus actuate the first cable 112 and the second cable 114. Actuation of the first and second cables 112 and 114 causes the valves 94 and 96 to close and thereby prevent further discharge of product from the storage tank 80.

While the solenoid valve 120 has been described as being electrically connected to the power source of the vehicle 10, it will be appreciated that the solenoid valve 120 may be electrically connected to other power sources separate from the vehicle 10. In this instance, a receiver will be interposed between the power source and the solenoid valve 120 with a shutdown signal being sent to the receiver from another transmitter.

One of the advantages of the present invention is that hazardous material may be quickly and safely contained in the storage tank of a vehicle and in a primary storage tank from a remote and safe distance from the vehicle and the storage tank. In addition, the use of fluid pressure to actuate the cable systems allows the force applied to the cable systems to be more readily regulated and thus enables the emergency discharge control system of the present system to operate effectively in harsh conditions, such as when the cable systems are coated with mud or ice.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. An emergency discharge control system in combination with a storage tank for remotely terminating the flow of product from the storage tank, the storage tank having a vapor valve and a liquid discharge valve, the emergency discharge control system comprising:

cable means connected to the vapor valve and the liquid discharge valve for closing the vapor valve and the liquid discharge valve when the cable means is moved from a first position wherein the vapor valve and the liquid discharge valve are in an open position to a second position wherein the vapor valve and the liquid discharge valve are in a closed position;

a cylinder having a piston and a piston rod associated therewith, the piston rod extending from the cylinder and connected to the cable means;

pressurized fluid means for actuating the piston and the piston rod from a retracted position wherein the cable means is positionable in the first position to an extended position wherein the cable means is caused to be moved to the second position, the pressurized fluid means being vapor from the storage tank;

valve means interposed between the cylinder and the pressurized fluid means for controlling the flow of the pressurized fluid means to the cylinder;

a hand-held transmitter responsive to an operator input for generating a shutdown signal; and receiver means electrically connected to the valve means for sending an electric signal to the valve means so as to cause the valve means to open and permit the pressurized fluid means to pass to the cylinder in response to receiving the shutdown signal from the transmitter.

2. The apparatus of claim 1 wherein the receiver means is mounted on a cargo tank motor vehicle.

3. The apparatus of claim 1 wherein the cylinder is slidably connected to the cable means.

4. An emergency discharge control system in combination with a cargo tank motor vehicle and a storage tank for remotely terminating the flow of product from the cargo tank of the cargo tank motor vehicle and the storage tank, each of the cargo tank and the storage tank having a vapor valve and a liquid discharge valve, the emergency discharge control system comprising:

first cable means connected to the vapor valve and the liquid discharge valve of the cargo tank for closing the vapor valve and the liquid discharge valve of the cargo tank when the first cable means is moved from a first position wherein the vapor valve and the liquid discharge valve of the cargo tank are in an open position to a second position wherein the vapor valve and the liquid discharge valve of the cargo tank are in a closed position;

second cable means connected to the vapor valve and the liquid discharge valve of the storage tank for closing the vapor valve and the liquid discharge valve of the storage tank when the second cable means is moved from a first position wherein the vapor valve and the liquid discharge valve of the storage tank are in an open position to a second position wherein the vapor valve and the liquid discharge valve of the storage tank are in a closed position;

a first cylinder having a piston and a piston rod associated therewith, the piston rod extending from the first cylinder and connected to the first cable means;

a second cylinder having a piston and a piston rod associated therewith, the piston rod extending from the second cylinder and connected to the second cable means;

first pressurized fluid means for actuating the piston and the piston rod of the first cylinder from a retracted position wherein the first cable means is positionable in the first position to an extended position wherein the first cable means is caused to be moved to the second position;

second pressurized fluid means for actuating the piston and the piston rod of the second cylinder from a retracted position wherein the second cable means is positionable in the first position to an extended position wherein the second cable means is caused to be moved to the second position, the second pressurized fluid means being vapor from the storage tank;

first valve means interposed between the first cylinder and the first pressurized fluid means for controlling the flow of the first pressurized fluid means to the first cylinder;

second valve means interposed between the second cylinder and the second pressurized fluid means for controlling the flow of the second pressurized fluid means to the second cylinder;

a hand-held transmitter responsive to an operator input for generating a shutdown signal; and receiver means mounted on the cargo tank motor vehicle and electrically connected to the first and second valve means for sending an electric signal to the first and second valve means so as to cause the first and second valve means to open and permit the first and second pressurized fluid means to pass to the first and second cylinders in response to receiving the shutdown signal from the transmitter.

5. The apparatus of claim 4 wherein the cargo tank motor vehicle has an ignition system, wherein the receiver means is electrically connected to a relay interposed between the receiver means and the ignition system, and wherein the receiver means sends an electric signal to the relay so as to cause power to be terminated to the ignition system in response to receiving the shutdown signal from the transmitter.

6. The apparatus of claim 4 wherein the each of the first and second cylinders is slidably connected to the first and second cable means, respectively.

* * * * *